US005775824A

United States Patent [19]

Bae

[11] Patent Number: 5,775,824

[45] Date of Patent: Jul. 7, 1998

[54] INK-JET PRINTING APPARATUS FOR EJECTING RECORDING PAPER UPON OPENING COVER THEREOF

[75] Inventor: Sang-Jin Bae, Suwon, Rep. of Korea

[73] Assignee: SamSung Electronics Co., Ltd., Suwon, Rep. of Korea

[21] Appl. No.: 788,795

[22] Filed: Jan. 27, 1997

[30] Foreign Application Priority Data

Jan. 25, 1996 [KR] Rep. of Korea ..... 1048/1996

[51] Int. Cl.[6] ..... B41J 13/02

[52] U.S. Cl. ..... 400/636; 400/636.1; 347/104

[58] Field of Search ..... 400/636, 636.1, 400/636.2, 625, 637, 637.1, 639.2, 639.1; 347/104, 108

[56] References Cited

U.S. PATENT DOCUMENTS

| | | | |
|---|---|---|---|
| 4,821,049 | 4/1989 | Eckl | 347/104 |
| 5,007,752 | 4/1991 | Yasumi et al. | 400/636 |
| 5,078,524 | 1/1992 | Sato | 400/636.1 |
| 5,120,146 | 6/1992 | Nakayasu et al. | 400/639.1 |
| 5,419,543 | 5/1995 | Nakamura | 347/104 |
| 5,511,774 | 4/1996 | Lyga | 271/273 |

FOREIGN PATENT DOCUMENTS

| | | | |
|---|---|---|---|
| 359579 | 3/1990 | European Pat. Off. | 400/636 |
| 1-182078 | 7/1989 | Japan | 400/636 |

*Primary Examiner*—Edgar S. Burr
*Assistant Examiner*—Anthony H. Nguyen
*Attorney, Agent, or Firm*—Robert E. Bushnell, Esq.

[57] ABSTRACT

A conveyance apparatus for an ink-jet printer for ejecting sheets of recording paper from the ink-jet printer regardless of whether the cover to the printer is closed or open. The ink-jet printing apparatus has a cartridge including a print head for forming an image on the recording paper. After passing the print head, the sheets of recording paper pass through the conveyance mechanism used to eject the sheets of recording paper. The ejecting occurs by pressing a spring loaded star-wheel against an eject roller. However, when the cover is opened, the star wheel becomes disengaged with the eject roller, causing the paper to jam instead of being ejected. To correct this problem, the star wheel engages a second eject roller when the cover is opened, allowing the paper to be ejected instead of jammed when the cover is opened.

14 Claims, 2 Drawing Sheets

INK-JET PRINTING APPARATUS FOR EJECTING RECORDING PAPER UPON OPENING COVER THEREOF

CLAIM OF PRIORITY

This application makes claims all benefits accruing under 35 U.S.C. §119 from an application for Ink-Jet Printing Apparatus For Ejecting Recording Paper Upon Opening Cover Thereof, earlier filed in the Korean Industrial Property Office on 25 Jan. 1996 and there duly assigned Serial No. 1048/1996.

BACKGROUND OF THE INVENTION

1. Field of the Invention

The present invention relates to an ink-jet printing apparatus and, more particularly, to an ink-jet printing apparatus for ejecting recording paper to an ejector without generating a paper jam upon opening a cover of the printing apparatus.

2. Description of the Related Art

The prior art discloses paper ejection mechanisms for ink-jet printers. For example, U.S. Pat. No. 5,511,774 for an Adjustable Pressure Roller Feeding Assembly Printer Having A Bail Roller Opening And Closing Mechanism to Lyga discloses a paper feeding assembly that contains two eject rollers and two pressure rollers. When one of the two pressure rollers should be lifted from an eject roller, the paper will not have to jam because the second pressure roller engages with the eject roller will convey the paper. As a result, paper jams are prevented when one of the eject rollers becomes unfunctionable.

In addition, U.S. Pat. No. 5,078,524 for a Paper Retaining Mechanism to Sato discloses a paper retaining mechanism that includes a paper retaining roller on a paper retaining lever. This paper roller can disengage from a platen depending on the rotation of a paper retaining lever. Sato '524 does not show the paper retaining roller engaging another roller besides platen.

U.S. Pat. No. 5,120,146 for a Printer Having A Bail Roller Opening And Closing Mechanism to Nakayasu et al. discloses a printer having a bail roller that can engage with and disengage with a platen roller depending on the setting of a crank. When disengaging with the platen roller, the bail roller does not engage with any other rollers or gears.

Lastly, U.S. Pat. No. 5,007,752 for a Paper Feed Roller Arrangement For Printer to Yasumi discloses a paper feed roller arrangement for a printer that contains a paper feed roller positioned on the end of a link. A paper roller can move between one of two positions. In one position, it is engaged with another paper feed roller. In other position, it is not engaged with any roller. When it is engaged with another feed roller, paper can be fed and processed normally. When disengaged from the paper feed roller, a ribbon cassette can be changed due to increased space created by moving the paper feed roller out of the way. When the paper feed roller is moved away from the ribbon cassette, it does not engage a second paper feed roller.

What is needed is a paper ejection mechanism that operates and prevents paper jams both when the cover is closed and the star-wheel is engaged to a first eject roller, and also when the cover is unlocked and opened and when the star-wheel is disengaged from the first eject roller, thus preventing paper jams in either scenario.

SUMMARY OF THE INVENTION

Therefore, it is an object to provide an ink-jet printing apparatus for ejecting recording paper upon the unlocking and opening of a cover, thereby solving the foregoing problem.

It is another object to provide an ink-jet printing apparatus for preventing recording paper from being jammed.

It is yet another object to provide a paper conveyance mechanism that selectively engages one of two eject rollers depending upon whether the cover is closed or open.

It is still another object to provide an ink-jet printing apparatus for enhancing the reliability of products by a user.

These and other objects may be achieved by providing a conveyance apparatus for an ink-jet printer for ejecting sheets of recording paper from the ink-jet printer regardless of whether the cover to the printer is closed or open. The ink-jet printing apparatus has a cartridge including a print head for forming an image on the recording paper. After passing the print head, the sheets of recording paper pass through the conveyance mechanism used to eject the sheets of recording paper. The ejecting occurs by pressing a spring loaded star-wheel against an eject roller. However, when the cover is opened, the star wheel becomes disengaged with the eject roller, causing the paper to jam instead of being ejected. To correct this problem, the star wheel engages a second eject roller when the cover is opened, allowing the paper to be ejected instead of jammed when the cover is opened.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Generally, steps for transferring recording paper in an ink-jet printing apparatus are divided into two. The first is to slightly slope a cassette in the rear of a body of the ink-jet printing apparatus, to load the provided cassette with recording paper, and thus to transfer the recording paper to a printer head by way of a paper feed roller. The other is to place the cassette loaded with the recording paper at a lower portion of the ink-jet printing apparatus and to eject the recording paper with passing through a transfer roller by a guide of a given format.

Firstly, in an ink-jet printing apparatus where the cassette is uprightly installed in the rear of the upper portion thereof, the recording paper moves to the printer head by way of the paper feed roller by ones and then, the printer head mounted on a cartridge moves in turn a shaft right and left, thereby performing the printing function on the recording paper. After that, the printed paper is transferred and ejected to an ejector by the transfer roller. Here, the ejector where a cover door is installed has a plurality of paper guides provided at intervals into an inner portion of the cover door.

Figure 1:
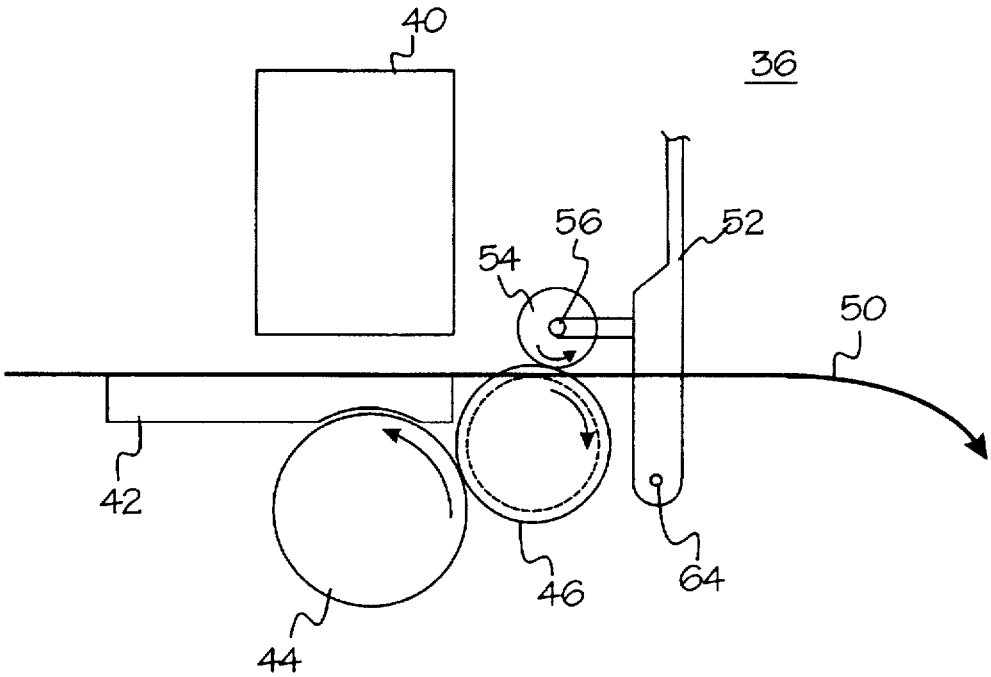
Fig. 1 PRIOR ART
FIG. 1 is a schematic diagram illustrating an earlier ink-jet printing apparatus showing the recording paper ejection process when the cover is in the closed and locked position.

Accordingly, an earlier ink-jet printing apparatus 36 as shown FIG. 1 consists of: a cartridge 40 having a printer head for forming a image on the recording paper 50, which is provided to an upper portion of a guide frame 42 of the ink-jet printing apparatus, and a driving gear 44. An eject roller 48 ejects recording paper 50 when being rotatably engaged with a star-wheel 54. Eject roller 48 is engaged to star-wheel 54 when cover 52 is closed in a locked position. Gear 46 is driven clockwise by the counterclockwise rotation of driving gear 44. Eject roller 48 is driven clockwise by gear 46. When cover 52 is closed and in a locked position as in FIG. 1, star-wheel 54 engages to eject roller 48 by the pressure created by spring 56. As a result, papers 50 conveyed under cartridge and print head 40 can be ejected by eject roller 48 engaging to star wheel 54.

Figure 2:
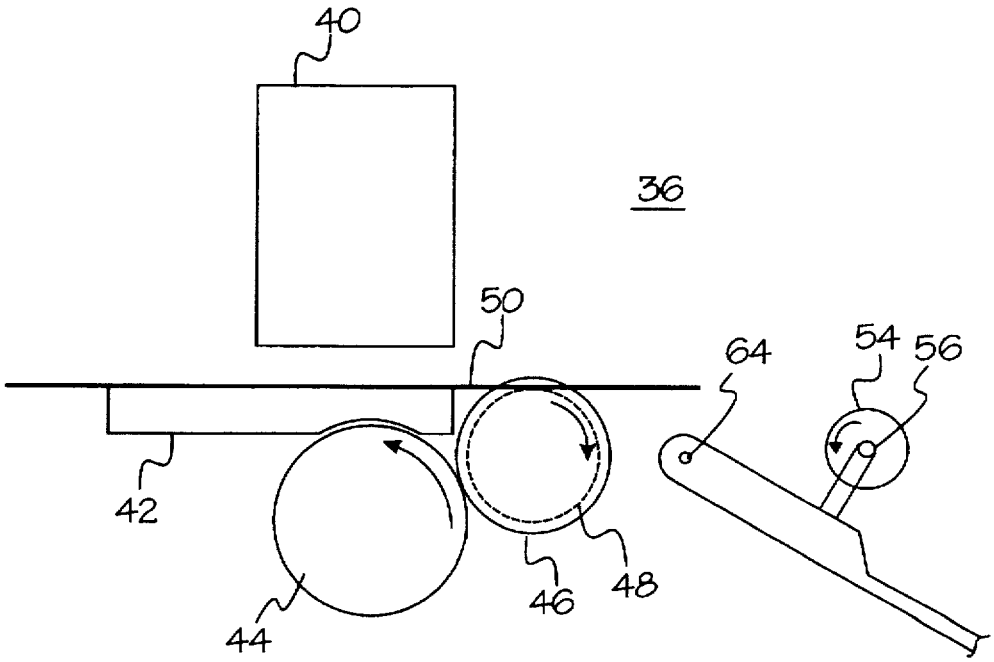
Fig. 2 PRIOR ART
FIG. 2 is a schematic diagram illustrating an earlier ink-jet printing apparatus showing the paper jamming process when the cover is in the open and unlocked position.

When cover 52 is opened and moved about hinge 64 to an unlocked position as shown in FIG. 2, star-wheel 54 no longer engages to eject roller 48. Consequently, papers emerging from cartridge 40 containing the print head become jammed as there is no longer any mechanism to convey the sheets of recording paper form the ink-jet printer, thereby generating the paper jam.

Figure 3:
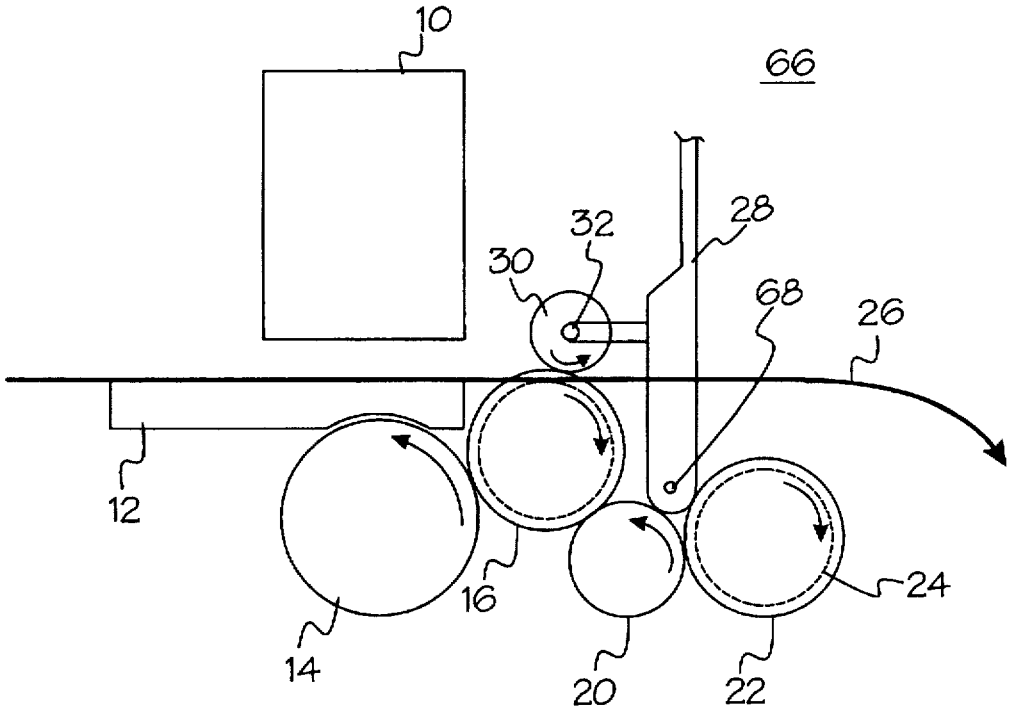
FIG. 3 is a schematic diagram illustrating the process of ejecting recording paper according to the present invention for the situation where the cover is in the closed and locked position.

Hereinafter, a preferred embodiment of the present invention will be concretely explained as below with the accompanying drawings. As depicted in FIG. 3, an ink-jet printing apparatus 66 for ejecting recording paper 26 upon opening a cover 28 according to the present invention is made up of a cartridge 10 where a printer head for forming an image on the recording paper 26 is installed, which is provided above guide frame 12 of the ink-jet print apparatus. Driving gear 14 drives first gear 16 to rotate in a clockwise direction. First gear 16 causes first eject roller 18 to rotate in a clockwise direction also. When cover 28 is in a closed and locked position as shown in FIG. 3, star-wheel 30 presses against first eject roller 18 by the force of spring 32. Star-wheel 30 pressing against first eject roller 18 provide a mechanism for ejecting paper 26 from the ink-jet printing apparatus when cover 28 is closed in a locked position as shown in FIG. 3. Meanwhile, first gear 16 causes idle gear 20 to rotate in a counterclockwise direction, which, in turn, causes second gear 22 to rotate in a clockwise direction, which causes second eject roller 24 to rotate idly in a clockwise direction.

Figure 4:
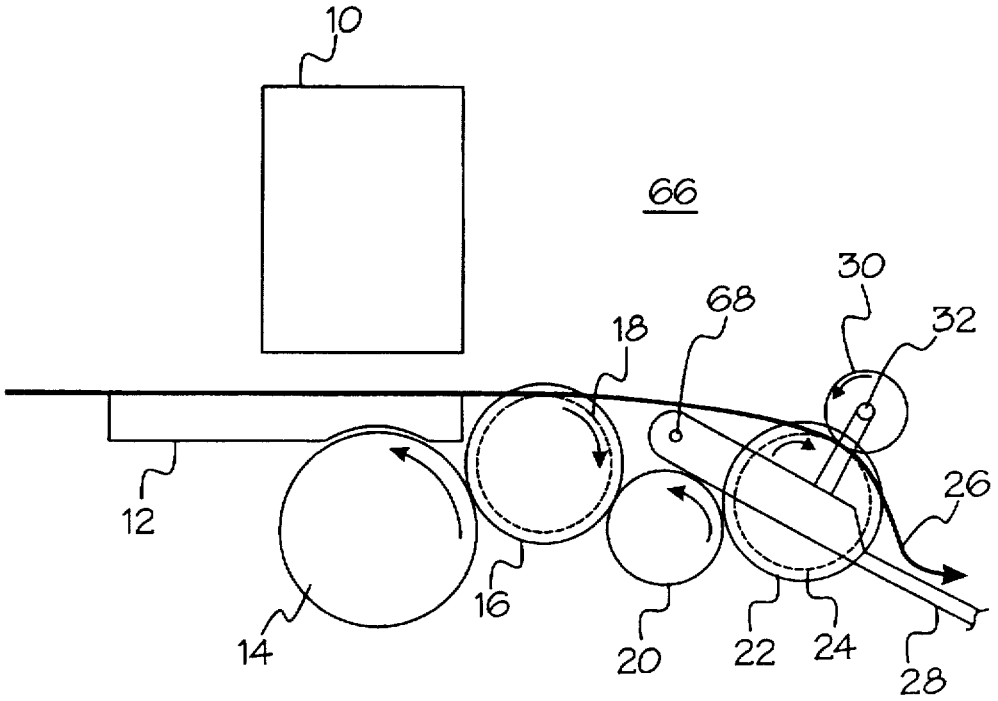
FIG. 4 is a schematic diagram illustrating the process of ejecting recording paper according to the present invention for the situation where the cover is in the open and unlocked position.

FIG. 4 depicts the ink-jet printing apparatus 66 when cover 28 is moved about hinge 68 to an open, unlocked position. Unlike the earlier representation of the ink-jet printer in FIG. 2, star-wheel 30 in FIG. 4 does not rotate idly when cover 28 is moved to an open, unlocked position. Instead, star-wheel 30 engages to second eject roller 24 when cover 28 is moved to an open, unlocked position. Spring 32 applies pressure to star-wheel 30 to engage to second eject roller 24, providing a mechanism for ejecting paper from the print head of cartridge 10. While second eject roller 24 is in pressurized contact with star-wheel 30, first eject roller 18 rotates idly.

As shown by FIGS. 3 and 4, star wheel 30 engages either first eject roller 18 or second eject roller 24 depending on whether or not cover 28 is in a closed, locked position or in an open, unlocked position. In either case, papers emerging from the printhead found in cartridge 10 can be ejected from the ink-jet printer without creating a paper jam.

As stated hereinafter, the ink-jet printing apparatus for ejecting the recording paper upon opening the cover of the printing apparatus according to the present invention can smoothly eject the recording paper because the star-wheel is contacted with the second eject roller to be continually rotated even when opening the cover in order that the user can check the printing status under printing. Further, since there is no stop in transferring the recording paper, it can not generate the paper jam. Accordingly, the inconvenience of the user may be reduced, thereby enhancing the reliability of products.

What is claimed is:

1. An ink-jet printing apparatus for ejecting recording paper upon opening a cover, said ink-jet printer having a cartridge including a printer head for forming an image on said recording paper, said ink-jet printer having a star-wheel for ejecting said recording paper that said image is formed, said cover having a spring for pressing said star-wheel under the given pressure, said ink-jet printer comprising:

a driving gear;

a first eject roller for ejecting said recording paper when engaged to said star-wheel upon locking said cover;

a first gear for actuating said first eject roller, said first gear driven by said driving gear;

a second eject roller for ejecting said recording paper when engaged to said star-wheel upon unlocking said cover;

a second gear for actuating said second eject roller; and, an idle gear for transferring the driving force of said first gear to said second gear.

2. The printing apparatus for ejecting said recording paper upon opening said cover as claimed in claim 1, said second eject roller and said star-wheel are pressed together with each other by said spring on said cover when said cover is lifted to said unlocked position.

3. An ink-jet printer, comprising:

a cover;

a star wheel having a spring, said star wheel connected to said cover;

a driving gear providing rotational energy;

a first gear driven by said rotational energy received from said driving gear;

an idle gear driven by said first gear;

a second gear driven by said idle gear;

a first eject roller driven by said first gear; and a second eject roller driven by said second gear, said star wheel selectively engaging one of said first eject roller and said second eject roller.

4. The ink-jet printer of claim 3, having a printer head cartridge and having a paper conveyance path comprising:

conveying sheets of paper under said printer head cartridge;

passing said paper over said first eject roller; and passing said paper over said second eject roller.

5. The ink-jet printer of claim 4, comprised of said star wheel being selectively engaged to said first eject roller when said cover is fastened in a closed position on said printer.

6. The ink-jet printer of claim 5, said star wheel is selectively engaged to said second eject roller when said cover is lifted off said printer into an open position.

7. The ink-jet printer of claim 6, said spring on said star wheel prevents said sheets of paper from being jammed when said star wheel engages said second eject roller by applying pressure between said star wheel and said second eject roller causing said sheets of paper to be ejected from said ink-jet printer.

8. The ink-jet printer of claim 7, said spring on said star wheel prevents said sheets of paper from being jammed when said star wheel engages said first eject roller by applying pressure between said star wheel and said second eject roller causing said sheets of paper to be ejected from said ink-jet printer.

9. The ink-jet printer of claim 6, said spring on said star wheel prevents said sheets of paper from being jammed when said star wheel engages said second eject roller by applying pressure between said star wheel and said second eject roller causing said sheets of paper to be ejected from said ink-jet printer.

10. The ink-jet printer of claim 9, said spring on said star wheel prevents said sheets of paper from being jammed when said star wheel engages said first eject roller by applying pressure between said star wheel and said second eject roller causing said sheets of paper to be ejected from said ink-jet printer.

11. A paper conveyance mechanism, comprising:

a cover;

a star wheel having a spring, said star wheel connected to said cover;

a driving gear;

a first gear driven by said driving gear;

an idle gear driven by said first gear;

a second gear driven by said idle gear;

a first eject roller driven by said first gear; and a second eject roller driven by said second gear, said star wheel selectively engaging one of said first eject roller and said second eject roller.

12. The paper conveyance mechanism of claim 11, further comprising:

a printer head cartridge; and a paper conveyance establishing a path conveying sheets of paper under said printer head cartridge, passing said paper over said fist eject roller, and passing said paper over said second eject roller.

13. The paper conveyance mechanism of claim 12, comprised of said star wheel being selectively engaged to said first eject roller when said cover is fastened in a closed position on said printer.

14. The paper conveyance mechanism of claim 13, comprised of said star wheel being selectively engaged to said second eject roller when said cover is lifted from said printer and moved into an open position.

* * * * *